US006553967B2

(12) United States Patent
Mahr

(10) Patent No.: US 6,553,967 B2
(45) Date of Patent: Apr. 29, 2003

(54) INJECTION NOZZLE

(75) Inventor: Bernd Mahr, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/985,485

(22) Filed: Nov. 5, 2001

(65) Prior Publication Data

US 2002/0053606 A1 May 9, 2002

(30) Foreign Application Priority Data

Nov. 3, 2000 (DE) ..... 100 54 526

(51) Int. Cl.[7] ..... F02M 41/16; F02M 55/02
(52) U.S. Cl. ..... 123/467; 239/96
(58) Field of Search ..... 123/446, 447, 123/467; 239/88–96

(56) References Cited

U.S. PATENT DOCUMENTS 5,671,715 A * 9/1997 Tsuzuki ..... 123/467
6,471,142 B1 * 10/2002 Lambert ..... 239/88
2001/0050316 A1 * 12/2001 Heinz ..... 239/96
2002/0088436 A1 * 7/2002 Kropp et al. ..... 123/467

* cited by examiner

*Primary Examiner*—Thomas N. Moulis
(74) *Attorney, Agent, or Firm*—Ronald E. Greigg

(57) ABSTRACT

An injection nozzle of a pressure-controlled fuel injection system has a control chamber for exerting pressure on a nozzle needle. The control chamber is connectable to a pressure reservoir via a pressure line that includes a 2/2-way valve. On the end of the nozzle needle that can be acted upon by pressure and is remote from the injection opening, a bore is embodied, by way of which the control chamber of the injection nozzle can be made to communicate with a leakage line as a function of the stroke of nozzle needle.

12 Claims, 2 Drawing Sheets

INJECTION NOZZLE

BACKGROUND OF THE INVENTION

1. Field of the Invention

The invention relates to an injection nozzle for use in a pressure-controlled fuel injection system for an internal combustion engine.

2. Description of the Prior Art

For the sake of better comprehension of the description and claims, several terms will now be explained: The fuel injection system of the invention is embodied as pressure-controlled. Within the context of the invention, the term pressure-controlled fuel injection system will be understood to mean that as a result of the fuel pressure prevailing in the nozzle chamber of an injection nozzle, a nozzle needle is moved counter to the action of a closing force (spring), so that the injection opening is uncovered for an injection of the fuel out of the nozzle chamber into the cylinder. The pressure at which fuel emerges from the nozzle chamber into a cylinder of an internal combustion engine is called the injection pressure, while the term system pressure is understood to mean the pressure at which fuel is available or is held in reserve within the fuel injection system. Fuel metering means furnishing a defined fuel quantity for injection. The term leakage is understood to mean a quantity of fuel that occurs in operation of the fuel injection system (for instance, a guide leakage), and that is not used for injection and is returned to the fuel tank. The pressure level of this leakage can have a standing pressure, and the fuel is then depressurized to the pressure level of the fuel tank.

In common rail systems, the injection pressure can be adapted to load and rpm. To reduce noise, a preinjection is often performed then. To reduce emissions, a pressure-controlled injection is known to be favorable.

Using a 2/2-way valve for triggering the injection nozzle is known from German Patent Disclosure DE 196 23 211 A1.

It is also known to employ a so-called varioregister nozzle in cam-driven systems. This injection nozzle with a reversible two-stage injection port cross section has until now been triggered via a pressure-controlled fuel injection system with a 3/2-way valve or with a cam-driven injection system.

OBJECT AND SUMMARY OF THE INVENTION

To reduce the costs of producing a fuel system, especially for small engines, an injection nozzle according to the invention uses only a single 2/2-way valve as a metering valve per cylinder. The design becomes more compact, because functions such as valve opening and hydraulically-reinforced opening and closure are integrated with the injection nozzle. A force-balanced construction of the nozzle needle of the varioregister nozzle is possible. In hydraulically reinforced opening of the nozzle needle, the injection nozzle opens as far as a stroke stop. The stroke stop can be embodied purely hydraulically or hydraulically-mechanically.

Triggering the injection nozzle can be employed both for injection nozzles opening in the direction of the injection chamber and those opening in the opposite direction. To that end, the throttles in the control chamber, and the control chamber itself and the piston, merely need to be adapted in a structurally simple way.

If the leakage line is used to trigger the hydraulic or hydraulic-mechanical stroke stop, a hydraulic connection to the injection nozzle can be omitted. The leakage line is dammed up to a higher pressure by means of one or more valves and suitable throttling or pressure maintenance valves. Preferably, a control unit in the leakage line should be used simultaneously for all the cylinders.

If the injection nozzle is embodied by a varioregister nozzle, instead of by a seat-type or blind-bore nozzle, then the course of injection can be adapted even better to the requirements of the engine.

BRIEF DESCRIPTION OF THE DRAWINGS

The invention will be better understood and further objects and advantages thereof will become more apparent from the ensuing detailed description taken in conjunction with the drawings; in which.

DESCRIPTION OF THE PREFERRED EMBODIMENTS

Figure 1:
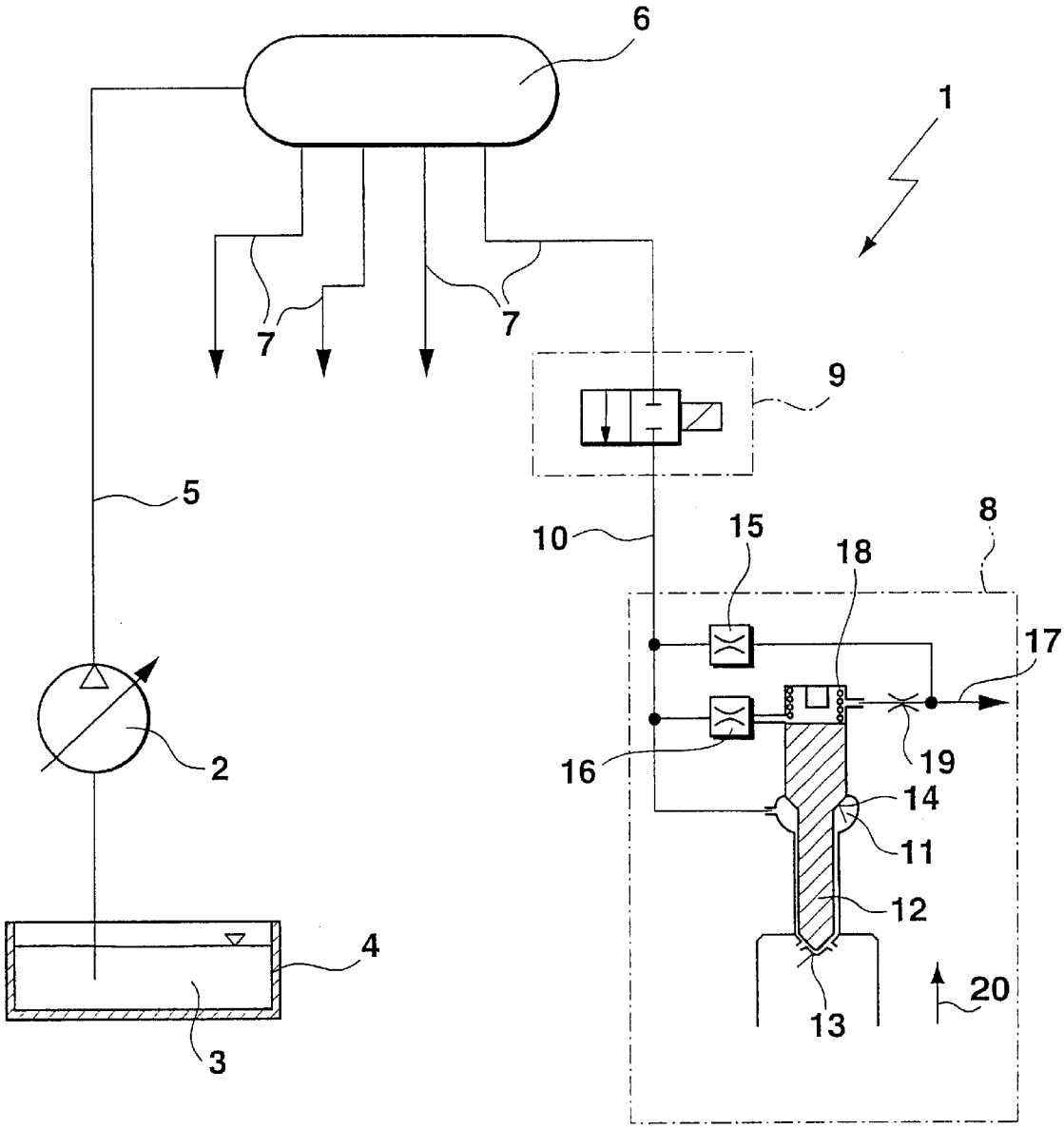
FIG. 1 illustrates the principle of a known pressure-controlled fuel injection system.

In the pressure-controlled fuel injection system 1 shown in FIG. 1, a quantity-controlled fuel pump 2 pumps fuel 3 out of a tank 4 via a supply line 5 into a central pressure reservoir 6 (common rail), from which a plurality of pressure lines 7, corresponding in number to the number of individual cylinders, lead to the individual injection nozzles 8, which protrude into the combustion chamber of the internal combustion engine to be supplied. In FIG. 1, only one of the injection nozzles 8 is shown in detail. With the aid of the fuel pump 2, a system pressure is generated and stored in the pressure reservoir 6, at a pressure of 300 to approximately 1800 bar.

Located in the region of the pressure reservoir 6 are metering valves 9, embodied as 2/2-way valves. The metering valve 9 is a directly actuated force-balanced magnet valve. With the aid of the metering valve 9, the injection is performed under pressure control for each cylinder. A pressure line 10 connects the metering valve 9 to a nozzle chamber 11. The injection is effected with the aid of a piston-shaped nozzle needle 12, which is axially displaceable in a guide bore and has a conical valve sealing face 13 on one end, the end with which it cooperates with a valve seat face on the housing of the injection nozzle 8. At the valve seat face of the housing, injection openings are provided. Inside the nozzle chamber 11, a pressure face 14, pointing in the opening direction of the nozzle needle 12, is exposed to the pressure prevailing there, which is delivered to the nozzle chamber 11 via the pressure line 10.

After the opening of the metering valve 9, a high-pressure fuel wave travels in the pressure line 10 to the nozzle chamber 11. The nozzle needle 12 is lifted from the valve seat face counter to a restoring force, and the injection event can begin.

A first pressure relief throttle 15 and a second pressure relief throttle 16 are assigned to the injection nozzle 8. Via the pressure relief throttle 15, the pressure line 10 has a permanent, continuously open communication with a leakage line 17. Via the pressure relief throttle 16 and a spring chamber 18, the pressure line 10 communicates with the leakage line 17 only when the injection opening is closed. The fuel injection system 1 therefore has, in addition to a pressure relief throttle 15 that is always open, a further pressure relief throttle 16, which can be closed by a stroke of the nozzle needle 12. The smaller pressure relief throttle 15 leads to reduced leakage during the injection. Upon termination of the injection, the pressure in the nozzle chamber 11 initially drops only via the pressure relief throttle 15, and the nozzle needle 12 begins its closing operation. As a result, the still-closed pressure relief throttle 16 is opened, so that the closing operation of the nozzle needle 12 is greatly accelerated. The pressure relief throttle 16 leads to a design of a fuel injection system without an unwanted postinjection. An optional further throttle 19 reduces the leakage still further.

Figure 2:
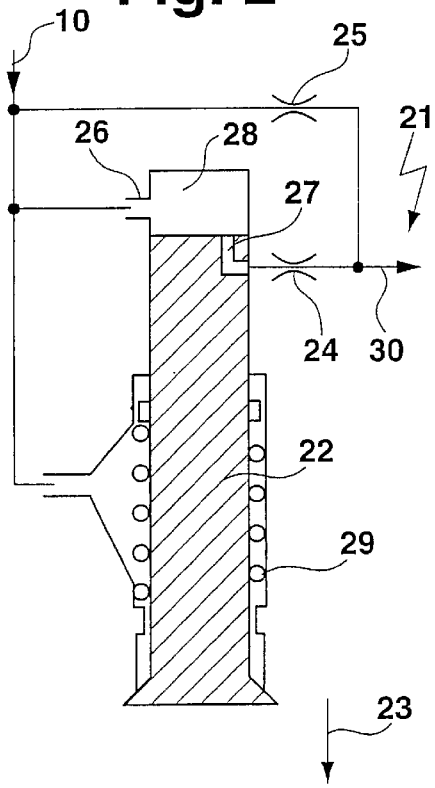
FIG. 2, in longitudinal section, shows a first injection nozzle that can be combined with the system of FIG. 1.

While the injection event takes place by means of a motion of the nozzle needle 12 inward in the direction 20, FIG. 2 shows a version of an injection nozzle 21 in which a nozzle needle 22 is moved outward in the direction 23 of the combustion chamber in order to perform the injection. In the drawings, the closing position is shown. The known technology of a hydraulic or mechanical stroke stop, for instance of the kind known from DE 196 23 211 A1, can be employed.

In FIG. 2, the closing event for the injection nozzles 21 and needles 22 takes place by means of the hydraulic cooperation of the outlet throttle 24 with the pressure relief throttle 25, with the inlet 26, and with the bore 27. For varying the leakage of a control chamber 28, the motion of the nozzle needle 22 is used. Via the pressure in the control chamber 28, the displacement of the nozzle needle 22 can be controlled. A pressure boost leads to opening, and a pressure reduction leads to the closing event, since the nozzle needle 22 is prestressed into the closing position by means of a spring 29. The bore 27, which connects the control chamber 28, connected to the supply line 10 for fuel, to a leakage line 30, is embodied on the head of the nozzle needle 22, remote from the valve seat.

If with increasing pressure at the onset of injection the nozzle needle 22 opens, the communication between the leakage line 30 and the bore 27 is reduced or interrupted as a consequence of the stroke motion in the direction 23. The opening stroke is performed in accelerated fashion, since the pressure in the control chamber 28 is rising.

After the end of the injection, with the valve 9 now closed (see FIG. 1) and with the resultant pressure reduction in the control chamber 28, the nozzle needle 22 moves in the direction of the closed position (the opposite direction from direction 23). The control chamber 28 is connected to the leakage line 30 again via the bore 27. The pressure in the control chamber decreases further, and the restoration by the spring 29 is hydraulically boosted. This hydraulically reinforced closure of the nozzle needle 22 speeds up the closing operation and prevents blowback or postinjections that could arise from pressure fluctuations.

Figure 3:
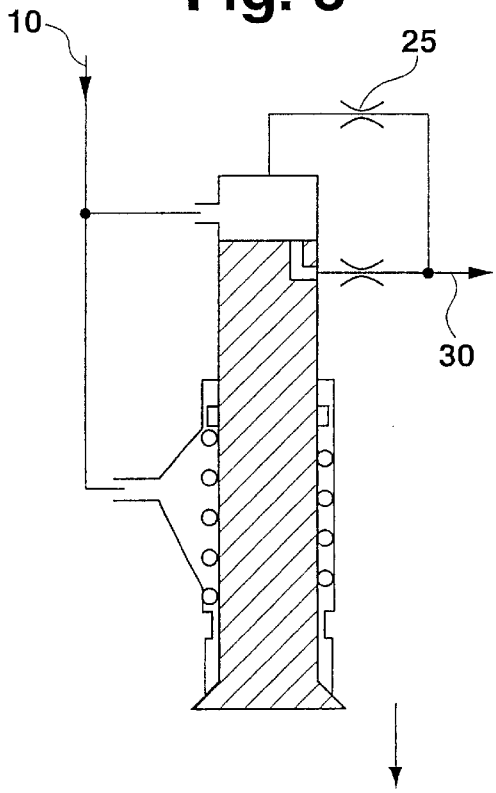
FIG. 3, in longitudinal section, shows a second injection nozzle that can be combined with the system of FIG. 1.

As an alternative to the embodiment of FIG. 2, the pressure relief of the fuel supply line 10 can also be embodied by providing that the control chamber 28 always communicates with the leakage line 30 via the pressure relief throttle 25 (FIG. 3).

Figure 4:
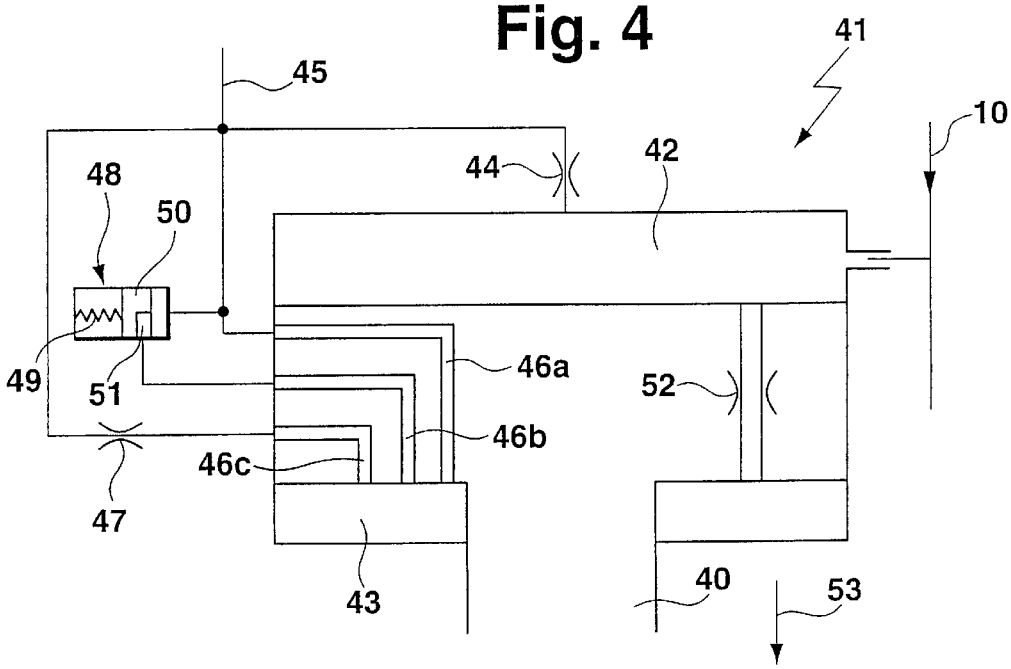
FIG. 4, in longitudinal section, shows a third injection nozzle that can be combined with the system of FIG. 1.

FIG. 4 shows that the motion of a nozzle needle 40 of an injection nozzle 41 for opening and closing is determined by the pressure ratios in a control chamber 42 and a work chamber 43. The control chamber 42 communicates permanently with a leakage line 45 via a pressure relief throttle 44. Also on the head remote from the valve seat, a plurality of bores 46*a*, 46*b*, 46*c* is embodied, by way of which bores the work chamber 43 can be connected in various ways to the leakage line 45. The bore 46*a* communicates directly with the leakage line. The bore 46*c* communicates with the leakage line via an outlet throttle 47. The bore 46 is connected to the leakage line 45 via an outlet control valve 48. The outlet control valve 48 opens at a specified pressure in the leakage line 45. A spring 49 is pressed backward via a piston 50, until a bore 51 comes to coincide with the supply line to the bore 46*b*. The result is multi-stage reliefs of pressure of the work chamber 43. The spacing of the bores 46*a* through 46*c* and the resultant stroke of the nozzle needle 40 are adapted to the spacing between a plurality of injection openings, disposed one above the other analogously to the bores 46*a*, 46*b* and 46*c*, on the other end of the nozzle needle 40 (multi-stage injection port cross section), so that in each stage, another injection opening or a plurality of injection openings are opened. Depending on the connection of the work chamber 43 to the leakage line 45, the work chamber being connected to the fuel supply line 10 via the throttle conduit 52, the opening in the direction of the arrow 53 or the closure of the nozzle needle 40 in the opposite direction is speeded up or slowed down, depending on which pressure, in the control chamber 42 or in the work chamber 43, is greater.

The foregoing relates to preferred exemplary embodiments of the invention, it being understood that other variants and embodiments thereof are possible within the spirit and scope of the invention, the latter being defined by the appended claims.

I claim:

1. In an injection nozzle (21; 41) of a pressure-controlled fuel injection system (1), having a control chamber (28; 42) for exerting pressure on a nozzle needle (22; 40), the control chamber (28; 42) being connectable to a pressure reservoir (6) via a pressure line (10) that includes a 2/2-way valve (9), the improvement wherein, on the end of the nozzle needle (22; 40) that can be acted upon by pressure and that is remote from the injection opening (13), a bore (36; 46*a*, 46*b*, 46*c*) is embodied, by way of which bore the control chamber (28; 42) and/or a work chamber (43) of the injection nozzle (21; 41) can be made to communicate with a leakage line (30; 45) as a function of the stroke of nozzle needle (22; 40).

2. The injection nozzle according to claim 1, wherein a supply line between the bore (36; 46*a*, 46*b*, 46*c*) and the leakage line (30; 45) includes an outlet throttle (24; 47).

3. The injection nozzle according to claim 1, wherein the control chamber (28; 42) additionally communicates with the leakage line (45) via a pressure relief throttle (25; 44).

4. The injection nozzle according to claim 2, wherein the control chamber (28; 42) additionally communicates with the leakage line (45) via a pressure relief throttle (25; 44).

5. The injection nozzle according to claim 1, wherein end of the nozzle needle (40) remote from the injection opening (13) separates the control chamber (42) from the work chamber (43), which communicates continuously with the control chamber (42) via a conduit (52), and wherein the other end of the nozzle needle (40) has a plurality of bores (46*a*, 46*b*, 46*c*), disposed one above the other in the longitudinal direction of the nozzle needle (40), by way of which bores the work chamber (43) can be made to communicate with the leakage line (45) in multiple stages, and the spacing of which bores is adapted to the spacing of a plurality of injection conduits disposed one above the other in the longitudinal direction.

6. The injection nozzle according to claim 2, wherein end of the nozzle needle (40) remote from the injection opening (13) separates the control chamber (42) from the work chamber (43), which communicates continuously with the control chamber (42) via a conduit (52), and wherein the other end of the nozzle needle (40) has a plurality of bores (46*a*, 46*b*, 46*c*), disposed one above the other in the longitudinal direction of the nozzle needle (40), by way of which bores the work chamber (43) can be made to communicate with the leakage line (45) in multiple stages, and the spacing of which bores is adapted to the spacing of a plurality of injection conduits disposed one above the other in the longitudinal direction.

7. The injection nozzle according to claim 3, wherein end of the nozzle needle (40) remote from the injection opening (13) separates the control chamber (42) from the work chamber (43), which communicates continuously with the control chamber (42) via a conduit (52), and wherein the other end of the nozzle needle (40) has a plurality of bores (46*a*, 46*b*, 46*c*), disposed one above the other in the longitudinal direction of the nozzle needle (40), by way of which bores the work chamber (43) can be made to communicate with the leakage line (45) in multiple stages, and the spacing of which bores is adapted to the spacing of a plurality of injection conduits disposed one above the other in the longitudinal direction.

8. The injection nozzle according to claim 4, wherein end of the nozzle needle (40) remote from the injection opening (13) separates the control chamber (42) from the work chamber (43), which communicates continuously with the control chamber (42) via a conduit (52), and wherein the other end of the nozzle needle (40) has a plurality of bores (46*a*, 46*b*, 46*c*), disposed one above the other in the longitudinal direction of the nozzle needle (40), by way of which bores the work chamber (43) can be made to communicate with the leakage line (45) in multiple stages, and the spacing of which bores is adapted to the spacing of a plurality of injection conduits disposed one above the other in the longitudinal direction.

9. The injection nozzle according to claim 5, wherein a bore (46*c*) communicates with the leakage line (45) via a throttle (47), and/or wherein another bore (46*b*) communicates with the leakage line (45) via a control valve (48), and/or wherein a further bore (46*a*) communicates directly with the leakage line (45).

10. The injection nozzle according to claim 6, wherein a bore (46*c*) communicates with the leakage line (45) via a throttle (47), and/or wherein another bore (46*b*) communicates with the leakage line (45) via a control valve (48), and/or wherein a further bore (46*a*) communicates directly with the leakage line (45).

11. The injection nozzle according to claim 7, wherein a bore (46*c*) communicates with the leakage line (45) via a throttle (47), and/or wherein another bore (46*b*) communicates with the leakage line (45) via a control valve (48), and/or wherein a further bore (46*a*) communicates directly with the leakage line (45).

12. The injection nozzle according to claim 8, wherein a bore (46*c*) communicates with the leakage line (45) via a throttle (47), and/or wherein another bore (46*b*) communicates with the leakage line (45) via a control valve (48), and/or wherein a further bore (46*a*) communicates directly with the leakage line (45).

* * * * *